US006657619B1

(12) United States Patent
Shiki

(10) Patent No.: US 6,657,619 B1
(45) Date of Patent: Dec. 2, 2003

(54) CLAMPING CIRCUIT FOR LIQUID CRYSTAL DISPLAY DEVICE

(75) Inventor: Tatsuya Shiki, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 274 days.

(21) Appl. No.: 09/602,182

(22) Filed: Jun. 22, 2000

(30) Foreign Application Priority Data

Jun. 25, 1999 (JP) ..... 11/180309

(51) Int. Cl.[7] ..... G09G 5/00

(52) U.S. Cl. ..... 345/204; 345/87; 345/88; 345/589; 345/690; 348/674; 348/675; 348/677; 348/694; 358/518; 358/519

(58) Field of Search ..... 345/87–90, 98, 345/99, 204, 63, 690, 77, 589, 590, 596; 348/222, 223, 241, 251, 254–258, 671, 673, 674–679, 683, 689, 719, 694; 358/518, 519, 521, 529, 530

(56) References Cited

U.S. PATENT DOCUMENTS 5,255,080 A * 10/1993 Kageyama et al. ..... 348/675
5,751,267 A * 5/1998 Sato et al. ..... 345/209
5,754,150 A * 5/1998 Matsui ..... 345/207
5,940,058 A * 8/1999 Koyama ..... 345/89
6,297,791 B1 * 10/2001 Naito et al. ..... 345/102
6,300,931 B1 * 10/2001 Someya et al. ..... 345/102
6,323,847 B1 * 11/2001 Kaneko et al. ..... 345/204
6,337,676 B1 * 1/2002 Anai et al. ..... 345/89

FOREIGN PATENT DOCUMENTS

| | | |
|---|---|---|
| JP | S60-178782 | 9/1985 |
| JP | S61-060570 | 4/1986 |
| JP | 64-78592 | 3/1989 |
| JP | 1-239590 | 9/1989 |
| JP | H02-145067 | 6/1990 |
| JP | H10-145706 | 5/1998 |
| JP | 11-113019 | 4/1999 |

* cited by examiner

*Primary Examiner*—Richard Hjerpe
*Assistant Examiner*—Henry N. Tran
(74) *Attorney, Agent, or Firm*—Scully, Scott, Murphy & Presser

(57) ABSTRACT

A clamping circuit for supplying a clamped color signal to a gamma-correction circuit is provided with a clamping portion connected to a clamping voltage generating circuit. The clamping voltage generating circuit generates a clamping voltage in response to an individual control signal in such a way that the black level of a color signal coincides with the black level in an input/output characteristic of the gamma-correction circuit. The clamping portion adds this clamping voltage to the pedestal level of a color signal at a predetermined timing in response to a control signal, so as to absorb variations in black levels of the clamping levels and later-stage circuits including variation in the later-stage circuits.

9 Claims, 7 Drawing Sheets

CLAMPING CIRCUIT FOR LIQUID CRYSTAL DISPLAY DEVICE

BACKGROUND OF THE INVENTION

1. Field of the Invention

The present invention relates to a clamping circuit for a liquid crystal display device, and more particularly to a clamping circuit for a large-screen and high-definition color liquid crystal display device of an active-matrix type.

2. Description of the Prior Art

Since a liquid crystal display device (LCD) of an active-matrix type using thin film transistors has advantages that it can drive two-dimensionally arranged pixel electrodes independently of one another, can implement a large-screen, high-definition and fine-gradation image display device, can be made compact thanks to its flat panel, can be driven by a low voltage and can be low in power consumption, the demand on it has been more and more expanded.

Since a liquid crystal display device of this kind sets a picture signal at a voltage suitable for driving liquid crystal, a black level in a picture signal is clamped to a predetermined clamping voltage. Furthermore, since the characteristic of transmissivity of liquid crystal to voltage applied to the liquid crystal is steep in the vicinity of the black level, the degree of gradation is lowered in the vicinity of the black level. To this end, so called gamma correction is performed, in which a picture signal is amplified by changing the degree of amplification in response to a picture signal level, which is called a gamma correction, is performed.

A clamping circuit for a liquid crystal display device clamps in general the black levels of analog RGB (Red, Green and Blue) picture signals to the same voltage.

In recent years, however, incorrect operation of a gamma-correction circuit and a coloring problem caused by variation in black level after a gamma correction are getting a great deal of attention as a problem to be solved.

On the other hand, in order to prevent the coloring problem caused by the difference in the characteristic of applied voltage to brightness among R, G and B signals of a LCD panel, a clamping circuit for a conventional liquid crystal display device described in Japanese Patent Laid-Open Publication No.Sho 64-78,592 has proposed to set pedestal clamping levels so that at least one of them is different from the other according to R, G and B color signals.

Referring to FIG. 1, a conventional clamping circuit for a liquid crystal display device is provided with three clamping circuits connected between three coupling capacitors and three gamma-correction circuits, respectively. The coupling capacitors 1, 2 and 3 are provided for receiving input color signals R, G and B of a picture signal VI to remove a direct current (DC) bias. Output signals from the coupling capacitors 1, 2 and 3 are inputted into the clamp units 400, 500 and 600, respectively, to output clamped color signals RC, GC and BC to the gamma-correction circuits 7, 8 and 9, respectively. The clamped color signals RC, GC and BC are obtained by newly adding a predetermined clamping voltage, which is the pedestal level of the picture signal, to the AC component of each of the color signals R, G and B whose DC bias has been cut. The gamma-correction circuits 7, 8 and 9 perform a predetermined gamma correction and amplification on each of the clamped color signals RC, GC and BC to output the respective output color signals RG, GG and BG.

The clamp unit 400 is provided with a clamping portion 410 for performing a clamping operation of adding a clamping voltage to the AC component of an inputted color signal R and outputting the clamped color signal RC, and a clamping voltage generating circuit 420 for generating and supplying a predetermined clamping voltage to the clamp unit 410.

The clamp unit 500 is provided with a clamping portion 510 for performing a clamping operation of adding a clamping voltage to the AC component of the inputted color signal G and outputting the clamped color signal GC.

The clamp unit 600 is provided with a clamping portion 610 for performing a clamping operation of adding a clamping voltage to the AC component of an inputted color signal B and outputting the clamped color signal BC, and a clamping voltage generating circuit 620 for generating and supplying a predetermined clamping voltage to the clamp units 510 and 610.

The clamping voltage generating circuits 420 and 620 are of the same composition, and referring to FIG. 2 showing with a block diagram the composition of the clamping voltage generating circuit 420 for the color signal R as a representative, the clamping voltage generating circuit 420 is provided with a variable resistor 423 for generating a divided voltage FR by dividing variably the voltage VDD of a power source and a buffer circuit 422 consisting of a voltage follower circuit for buffer-amplifying the divided voltage FR and outputting a clamping voltage CR.

In the same way, the clamping voltage generating circuit 620 is provided with a variable resistor and a buffer circuit.

Now, operation of a clamping circuit of a conventional liquid crystal display circuit is described with reference to FIG. 1 and FIG. 2. The color signals R, G and B of the input picture signal VI are supplied to the respective systems. The coupling capacitors 1, 2 and 3 are provided to eliminate only the DC components of the color signals R, G and B since the respective DC components are not constant. The AC component of each of the color signals R, G and B, in which the DC components are eliminated by the capacitors 1 to 3, varies in black level according to the kind of a picture signal in a state of leaving as it is (for example, an inverse character display and a normal character display are different in black level), and therefore it is difficult to perform a later-stage process such as a gamma correction and the like. Thereupon, in order to prevent the black level of a picture signal from varying, pedestal level clamping circuits are provided for reproducing the DC components to the AC components of the color signals R, G and B. The foregoing circuits are called the clamp units 400, 500 and 600.

The processing system of the color signal R is explained as a representative in the following. The clamping voltage generating circuit 420 in the clamp unit 400 generating a divided voltage FR corresponding to a desired clamping voltage CR by dividing a power voltage VDD by means of the variable resistor 423. The buffer circuit 422 buffer-amplifies the divided voltage, generates and supplies a clamping voltage CR to a clamping portion 410. The clamping portion 410 operates so as to superpose the supplied clamping voltage CR on the pedestal level of the AC component of a color signal R, namely, the black level of a color signal R and outputs a clamped color signal RC. This is a clamping operation.

In the same way, clamped color signals GC and BC are outputted by performing clamping operations in the systems of color signals G and B.

In such a way, in a conventional clamping circuit the clamped color signals RC, and GC and BC can set their black levels independently. In this example the clamped color signals GC and BC are interlocked, but they can be composed so that they can be set independently of each other. However, once these clamped voltages, namely, the black levels are set, their settings are fixed as they are.

On the other hand, the black levels to be set of the gamma-correction circuits 7, 8 and 9 at a later stage of the clamp units 4, 5 and 6 are ideally set aiming at a predetermined voltage. As a matter of fact, however, the black levels vary among signals R, G and B or even among the gamma-correction circuits of the same color due to variation in accuracy of the gamma-correction circuits.

As shown in FIG. 3 showing an example of the input/output characteristic of a gamma-correction circuit, however, when the black level of an output of a clamping circuit is fixed, the black level of the output of the clamping circuit may become different from the black level of the gamma-correction circuit. In such a state, therefore, a gamma correction cannot be correctly performed.

If the black level of a gamma-correction circuit varies, a circuit at a later stage of the gamma-correction circuit results in operating incorrectly due to that variation and for example the black level results in being corrected slightly toward the white side. As the result, a disadvantage that the display becomes whitish or poor in contrast occurs.

Moreover, since the clamping voltages are set individually but fixedly, there is a problem of deterioration in color reproductivity or degradation in gamma-correction curves due to a fact that the correction may become an inverse correction depending upon variation in a process at a later stage of the clamping circuit.

Since a clamping circuit for a conventional liquid crystal display device as described above can set a clamping level for each of color signals R, G and B but cannot change the clamping level so as to absorb variation in black level of gamma-correction circuits and the like at a later stage of the clamping circuit, it has a disadvantage that if the black levels of a later-stage circuit vary, the later-stage circuit operates incorrectly due to that variation.

Furthermore, since the clamping voltages are set individually but fixedly, there is a disadvantage of deterioration in color reproductivity or degradation of gamma-correction curves due to a fact that the correction may become an inverse correction depending upon variation in a later stage of the clamping circuit.

SUMMARY OF THE INVENTION

An object of the present invention is to provide a clamping circuit for a liquid crystal display device which performs prevention of a coloring phenomenon as well as optimization of a gamma correction due to a circuit composition and prevention of deterioration in contrast by making it possible to adjust the black levels of clamping levels and the black levels of circuits at later stages of the clamping circuits so as to absorb variation in black levels of these circuits including the later-stage circuits.

According to the present invention, a clamping circuit for a liquid crystal display device has a plurality of clamp units for receiving a plurality of input color signals of an input picture signal after deleting a DC bias from each of the input color signals to produce a plurality of clamped color signals, respectively, by adding a predetermined clamping voltage corresponding to a pedestal level of the input picture signal to each of the input color signals. Furthermore, a plurality of gamma-correction circuits are connected to the clamp units for receiving the clamped color signals, respectively, and for performing a predetermined gamma correction and amplification on each of the clamped color signals to produce output color signals, respectively. Each of the clamp units is provided with a clamping portion for receiving the input color signal and a clamping voltage generating circuit for supplying a clamping voltage to the clamping portion so as to be controlled in response to an individual first control signal supplied thereto and generates the clamping voltage such that a black level of the clamped color signal coincides with a black level in an input/output characteristic of the gamma-correction circuit. The clamping portion is supplied with the clamping voltage so as to add the clamping voltage to the pedestal level of the input color signal at a predetermined timing in response to a second control signal supplied thereto.

The pedestal level may be a level corresponding to the black level of an input picture signal, or the black level of a picture signal may correspond to a setup level which is slightly higher by a certain voltage than the pedestal level.

The clamping voltage generating circuit may be provided with a D/A correction circuit for performing a digital-to-analog (D/A) correction on a digital data signal contained in the first control signal and outputting an analog voltage signal, and a buffer circuit for buffer-amplifying the analog voltage signal and outputting the clamping voltage.

The clamping portion may be provided with a switch circuit for conducting or shutting a clamping voltage in response to the level of the second control signal.

Furthermore, it may be provided with a control means for outputting a first and a second control signal, and a memory means for memorizing data from said control means and reading and supplying the memorized data to the control means.

The first control signal may be a serial control signal of a 3-line control method, and may have a digital data signal corresponding to the clamping voltages so as to be supplied to three control lines thereof, a clock signal for synchronization of this digital data signal and a strobe signal for specifying a clamping voltage generating circuit to be controlled.

The second control signal may be a signal which comes to be at high level "H" for only a specific period of the pedestal level of a color signal for one horizontal scanning period which is one period of a horizontal synchronizing signal, and may be generated by shifting the phase of the horizontal synchronizing signal by a predetermined time and inverting this shifted horizontal synchronizing signal.

According to the present invention, a clamping circuit of a liquid crystal display device is provided with a clamping circuit for adding newly a predetermined clamping voltage corresponding to the black level corresponding to a setup level which is a level higher by a certain voltage than the pedestal level of a picture signal to a color signal having a direct current (DC) bias cut for each color signal of the inputted picture signal and outputting a clamped color signal, and a gamma-correction circuit for performing a predetermined gamma correction and amplification on the supplied clamped color signal and outputting an output color signal, wherein a clamping circuit for each color signal is provided with a clamping voltage generating circuit which is controlled in response to the individual first control signal and generates a clamping voltage such that the black level of a clamped color signal coincides with the black level in an input/output characteristic of a gamma-correction circuit, and a clamping portion which is supplied with a clamping voltage and adds the clamping voltage to the pedestal level in a predetermined timing of a color signal in response to the second control signal.

And in case that the black level of a picture signal corresponds to a setup level higher by a certain voltage than a pedestal level, the clamping voltage generating circuit may set the clamping level at the black level by setting the value of a digital data signal corresponding to a clamping voltage contained in the first control signal lower by the setup level portion than the pedestal level.

DETAILED DESCRIPTION OF THE PREFERRED EMBODIMENTS

Figure 1:
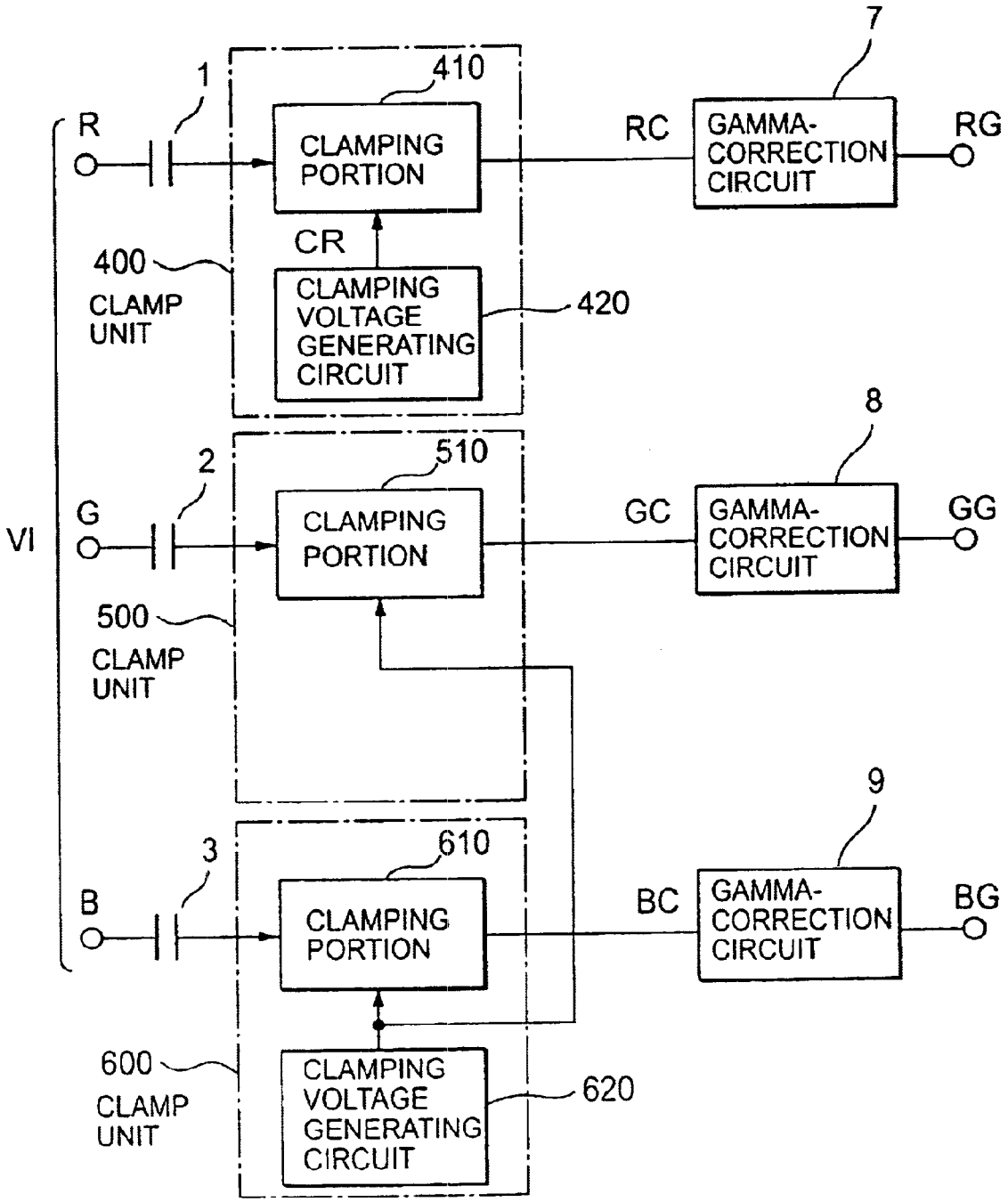
FIG.1 (PRIOR ART)
FIG. 1 is a block diagram showing an example of a clamping circuit of a conventional liquid crystal display device.
Figure 2:
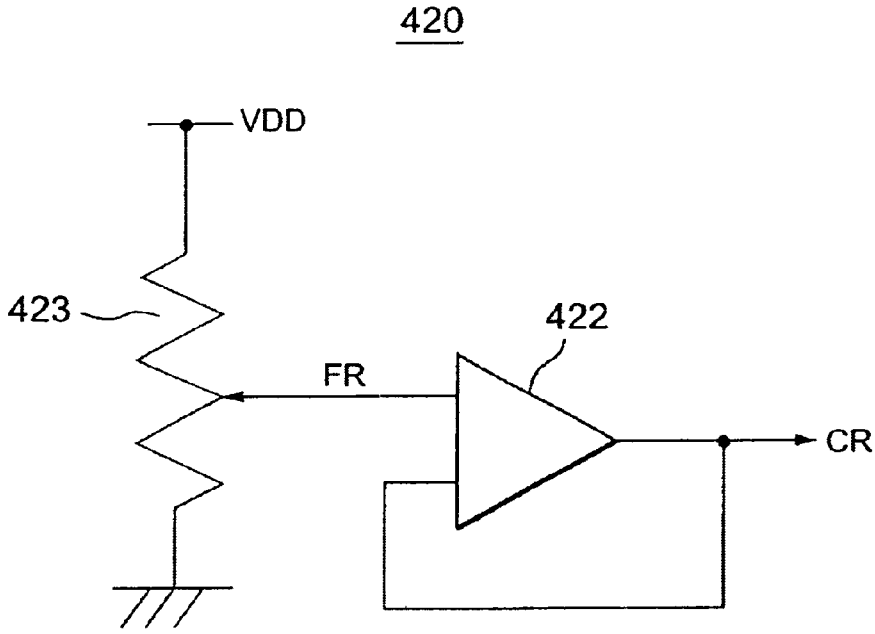
FIG.2 (PRIOR ART)
FIG. 2 is a circuit diagram showing the composition of a clamping voltage generating circuit in FIG. 1.
Figure 4:
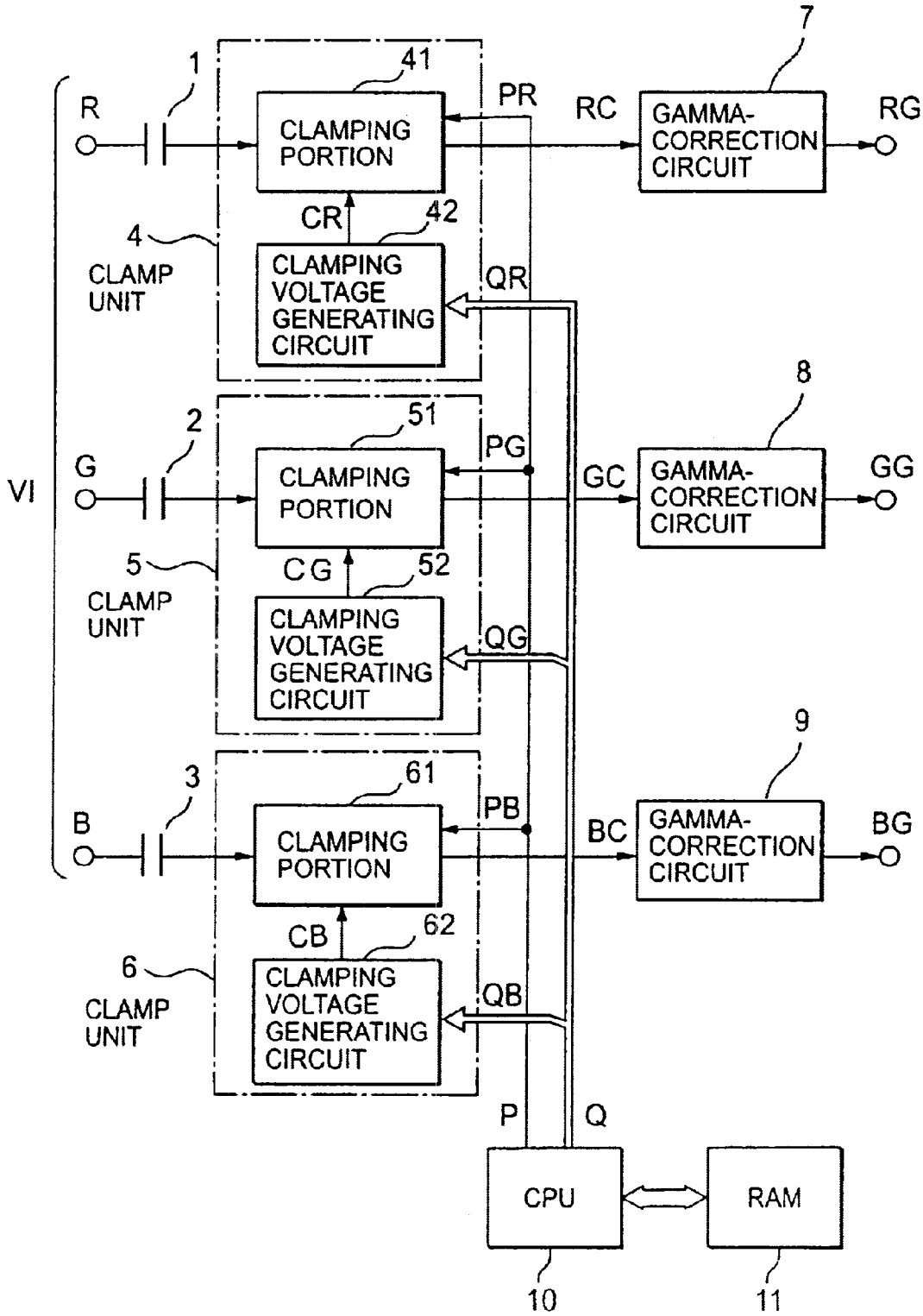
FIG. 4 is a block diagram showing an embodiment of a clamping circuit of a liquid crystal display device of the present invention.

Referring to FIG. 4, a preferred embodiment of the present invention is described in which components common to FIG. 1 and FIG. 4 are given the common reference characters/numerals and are similarly represented by blocks. A clamping circuit of a liquid crystal display device of this embodiment shown in FIG. 4 is provided with coupling capacitors 1, 2 and 3 each cutting a direct current (DC) bias in each of the color signals R, G and B of an inputted picture signal VI common to the conventional example, gamma-correction circuits 7, 8 and 9 for performing predetermined gamma correction and amplification respectively on the clamped color signals RC, GC and BC and outputting the output color signals RG, GG and BG, and additionally, clamp units 4, 5 and 6 instead of the conventional clamp units 400, 500 and 600. The clamp units 4, 5 and 6 are respectively controlled by individual control signals PR, QR, PG, QG, PB and QB (hereinafter referred to as control signals P and Q in case of collectively describing them) for the respective color signals R, G and B and newly adding predetermined clamping voltages being the pedestal level of a picture signal to the AC components of the color signals. R, G and B and outputting respectively the clamped color signals RC, GC and BC. A control unit such as a central processing unit (CPU) 10 generates and supplies individual control signals PR, QR, PG, QG, PB and QB for the respective color signals R, G and B to the clamp units 4, 5 and 6 by means of a serial 3-line control method. A memory unit such as a random access memory (RAM) 11 memorizes data supplied from the CPU 10 and exchanges data with the CPU 10 by reading and supplying the memorized data to the CPU 10.

The clamp unit 4 is provided with a clamping portion 41 controlled by a control signal PR and a clamping voltage generating circuit 42 controlled by a control signal QR. The clamping portion 41 performs a clamping operation of adding a clamping voltage CR to the AC component of an input color signal R and outputs the clamped color signal RC. The clamping voltage generating circuit 42 generates and outputs a clamping voltage CR to the clamping portion The clamp unit 5 is provided with a clamping portion 51 controlled by a control signal PG and a clamping voltage generating circuit 52 controlled by a control signal QG. The clamping portion 51 performs a clamping operation of adding a clamping voltage CG to the AC component of an inputted color signal G and outputs a clamped color signal GC. The clamping voltage generating circuit 52 generates and outputs a clamping voltage CG to the clamping portion 51.

The clamp unit 6 is provided with a clamping portion 61 controlled by a control signal PB and a clamping voltage generating circuit 62 controlled by a control signal QB. The clamping portion 61 performs a clamping operation of adding a clamping voltage CB to the AC component of an inputted color signal B and outputs a clamped color signal BC. The clamping voltage generating circuit 62 generates and supplies a clamping voltage CB to the clamping portion 61.

Figure 5:
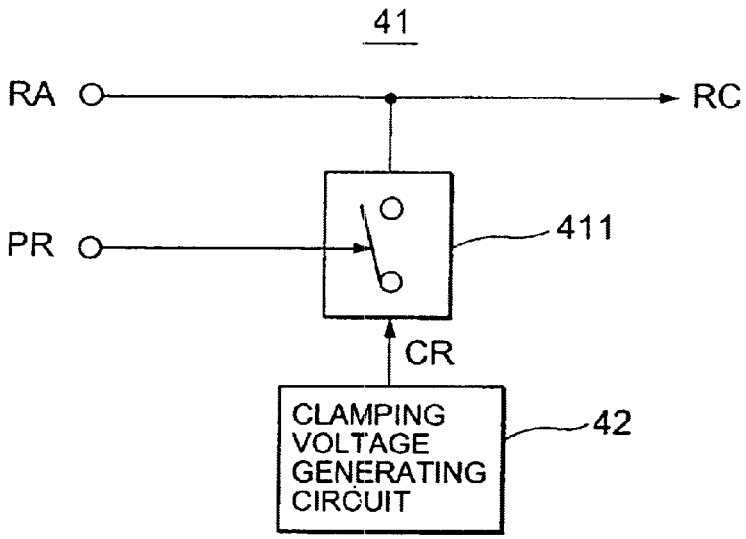
FIG. 5 is a block diagram showing the composition of a clamping portion in FIG. 4.

The clamp units 4, 5 and 6 are of the same composition, and referring to FIG. 5 showing with a block diagram the composition of the clamping portion 41 of the clamp unit 4 for a color signal R as a representative. The clamping portion 41 is provided with a switch circuit 411 for turning on/off a clamping voltage CR supplied from the clamping voltage generating circuit 42 in response to the control of a control signal PR.

In the same way, the clamping portions 51 and 61 are respectively provided with switch circuits.

Figure 6:
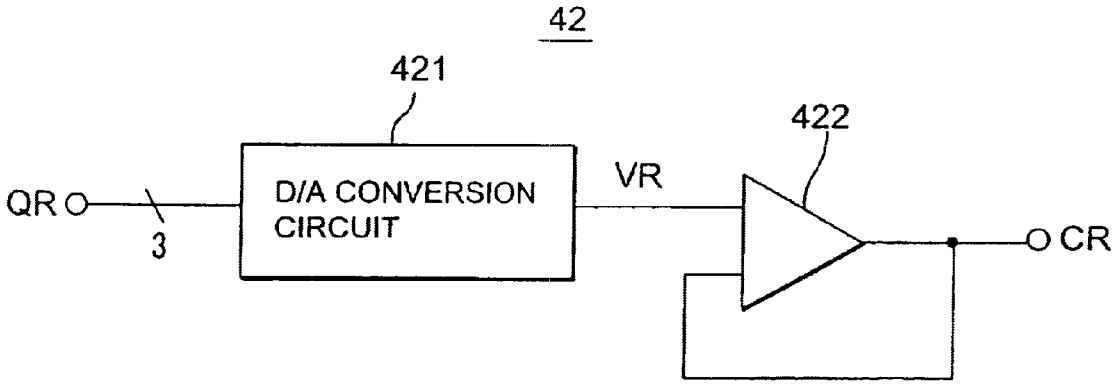
FIG. 6 is a block diagram showing the composition of a clamping voltage generating circuit in FIG. 4.

Referring to FIG. 6, the composition of a clamping voltage generating circuit 42 of the clamp unit 4 for a color signal R is explained with a block diagram as a representative. This clamping voltage generating circuit 42 is provided with a D/A conversion circuit 421 and a buffer circuit 422. D/A conversion circuit 421 is provided for performing a digital-to-analog (D/A) conversion on a digital data signal (hereinafter referred to as a data signal) contained in a control signal QR and outputting a clamping signal VR as an analog signal. The buffer circuit 422 has a voltage follower circuit for buffer-amplifying a clamping signal VR and outputting a clamping voltage CR.

In the same way, the clamping voltage generating circuits 52 and 62 for color signals G and B are each provided with a D/A conversion circuit and a buffer circuit.

Operation of this embodiment is described with reference to FIG. 4, FIG. 5 and FIG. 6. Here, as a representative, a system for a color signal R is described. When a color signal R forming an input picture signal VI is supplied, capacitor 1 cuts or deletes a DC bias from the color signal R and supplies only the AC component (hereinafter referred to as a color signal RA) of the color signal R to the clamp unit 4. The clamp unit 4 reproduces the DC bias by clamping the pedestal level portion of the color signal RA. The clamp unit 4 clamps the pedestal level voltage, namely, the black level of the picture signal R to a clamping voltage CR from the clamping voltage generating circuit 42 to be given to the clamping portion 41 and then outputs a clamped color signal RC. As described later, the clamping voltage generating circuit 42 is composed so as to be able to vary the clamping voltage CR.

Figure 7:
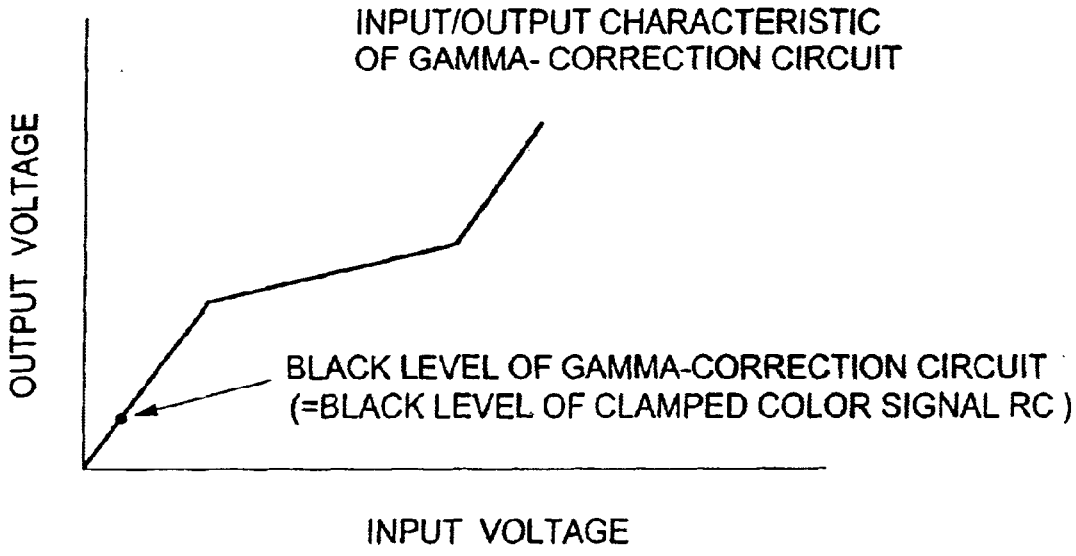
FIG. 7 is an input/output characteristic diagram showing an example of operation of a gamma-correction circuit according to the present invention.

Referring also to FIG. 7 showing with a graph an input/output characteristic of the gamma-correction circuit 7, the clamping voltage generating circuit 42 adjusts this process of varying the clamping voltage CR so that the black level voltage of the clamped color signal RC and the black level which the gamma-correction circuit 7 has coincide with each other in order to absorb variation in black level of the gamma-correction circuit 7 itself at a later stage of the clamping portion 41. As the result, the gamma-correction circuit 7 comes to be supplied with the black level voltage of a clamped color signal RC which has coincided with the black level which the gamma-correction circuit 7 has.

The CPU 10 and the RAM 11 supply a control signal QR to the clamping voltage generating circuit 42 for a color signal R and control a clamping voltage CR outputted from the clamping voltage generating circuit 42. And they supply a control signal PR to the clamping portion 41 and control its clamping operation.

In the same way, the systems for color signals G and B are also of the same composition, reproduce DC bias and output respectively clamped color signals GC and BC.

Figure 8:
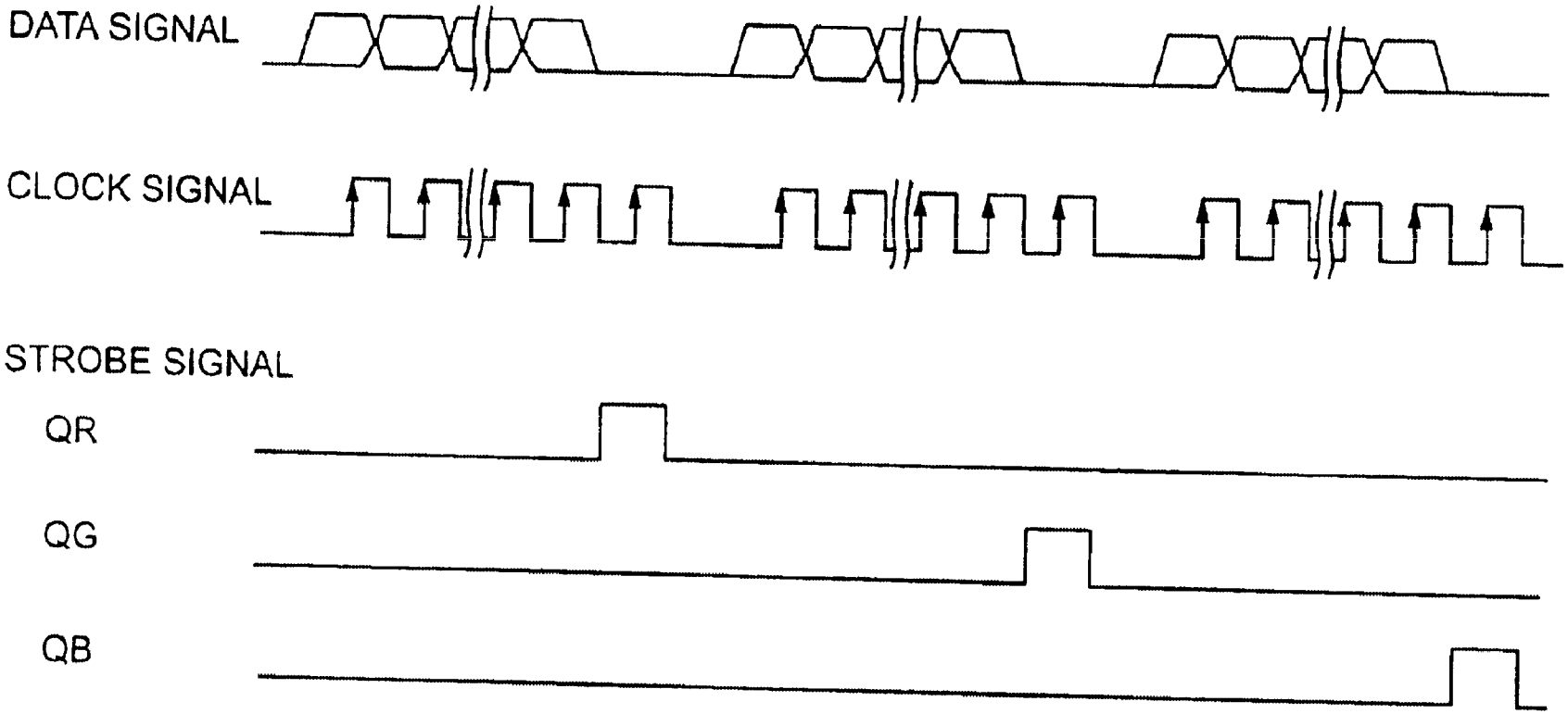
FIG. 8 is a timing chart for explaining a serial control signal used in the present invention.

A control signal Q supplied by the CPU 10 is a serial control signal of a general 3-line control method as shown in FIG. 8, and is composed of a data signal, a clock signal and a strobe signal to be respectively supplied to a control bus line. In this embodiment, it is assumed that the data signal is digital data of 8 bits. As publicly known, the clock signal is used for synchronization of the data signals, and the strobe signal is a selection signal for activating one of the clamping voltage generating circuits 42, 52 and 62. Here, as described above, a strobe signal of a control signal Q selects a color signal R system and this state is called a control signal QR. Similarly, a state of selecting a color signal G system is called QG, and a state of selecting a color signal B system is called QB. Namely, a data signal and a clock signal are used commonly to R, G and B, and a strobe signal is controlled individually in such a way as QR, QG and QB.

Referring to FIG. 6, the D/A conversion circuit 421 in the clamping voltage generating circuit 42 D/A-converts a data signal forming a control signal QR sent from the CPU and outputs a clamped color signal VR. The D/A conversion circuit 421 is a D/A conversion circuit of 8 bits and its output dynamic range is set at 1.22 to 3.77 V. For example, assuming that a data signal is 80 (Hex), the D/A conversion circuit 421 outputs as a clamping signal VR a voltage of 2.5 V that is the central value of said output dynamic range. The buffer circuit 422 is a voltage follower circuit using a transistor having a sufficiently large driving capability in its output stage in order to secure an output current driving capability for the clamping portion 41, namely, the gamma-correction circuit 7 at a later stage, and buffer-amplifies an inputted clamping signal VR and outputs a clamping voltage CR. The reference numeral 3 at the left-hand side of FIG. 6 represents a 3-line structure composed of a data signal, a clock signal and a strobe signal, and it is a matter of course that the number of bits of the data signal out of them is 8 bits.

In the same way, with respect to the systems for the color signals G and B also, the clamping voltage generating circuits 52 and 62 operate as described above. Therefore, the black level voltages of the respective color signals R, G and B can be controlled independently of one another.

Figure 9:
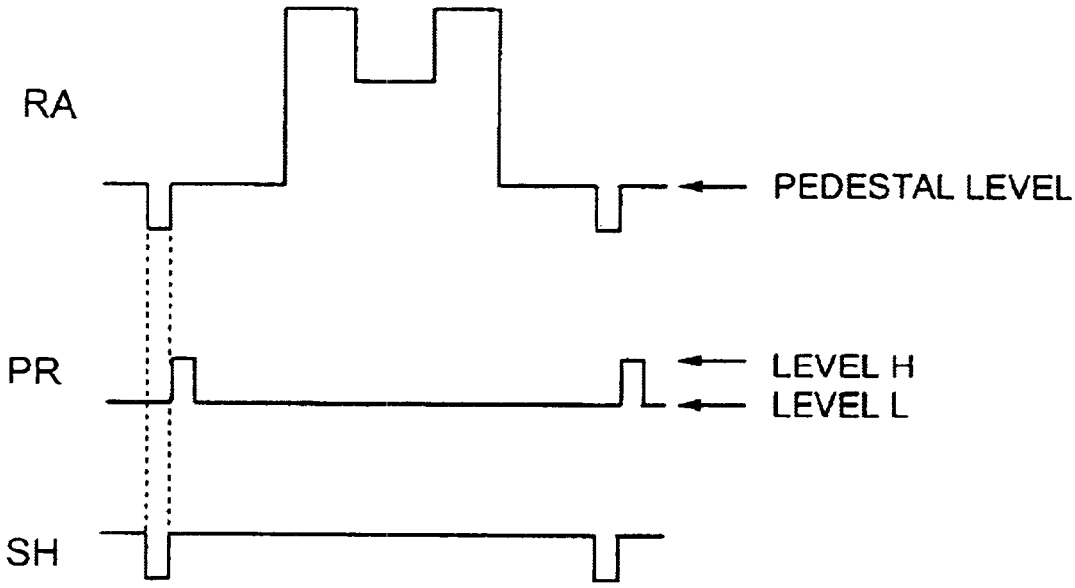
FIG. 9 is a timing chart showing an example of operation of a clamping circuit of a liquid crystal display device according to the present invention.

Operation of the clamping portion 41 is now described with reference to FIG. 5 and FIG. 9 showing waveform of each signal of the clamping portion 41 with a timing chart. The clamping portion 41 turns on the switch circuit 411 in response to the control of a control signal PR supplied from the CPU 10, and applies a clamping voltage CR from the clamping voltage generating circuit 42 to only a specific part shown in FIG. 9 of the pedestal level of a color signal RA. The color signal RA comes to be at level of high "H" for only said specific period of the pedestal level of the color signal RA of one horizontal scanning period which is one period of a horizontal synchronizing signal SH. The level "H" of a control signal PR to be generated by the CPU 10 can be easily generated by shifting the phase (timing) of the horizontal synchronizing signal SH by a predetermined time and inverting the shifted signal by means of an inverter or the like. The part of the pedestal level is a part where the black level is inserted as a picture signal in a non-display period of a picture signal VI, namely, in a non-display period of a color signal RA. The switch circuit 411 is turned on in response to the level "H" of a control signal PR. Accordingly, a clamping voltage CR is superposed on the black level of a color signal RA for a period where the switch circuit 411 is on. In such a way, for a period of the pedestal level of a color signal R, a black level voltage comes to be in a state where it is clamped to a fixed clamping voltage, and is outputted as a clamped color signal RC.

On the other hand, a state where the switch circuit 411 is turned off by level of low "L" of a control signal PR attempts to hold a clamping voltage CR for a fixed period by means of a discharging current from the capacitor 1. However, the circuitry operation is intended to perform this clamping operation in each horizontal scanning period. Therefore, the black level of a clamped color signal RC can be always kept constant by optimizing the constant of the capacitor 1.

Since the gamma-correction circuits 7, 8 and 9 are not directly related to the present invention, explanation of their detailed composition is omitted. Each of the gamma-correction circuits 7, 8 and 9 processes as an analog signal each of supplied clamped color signals RC, GC and BC according to an input/output characteristic curve shown in FIG. 7.

Figure 3:
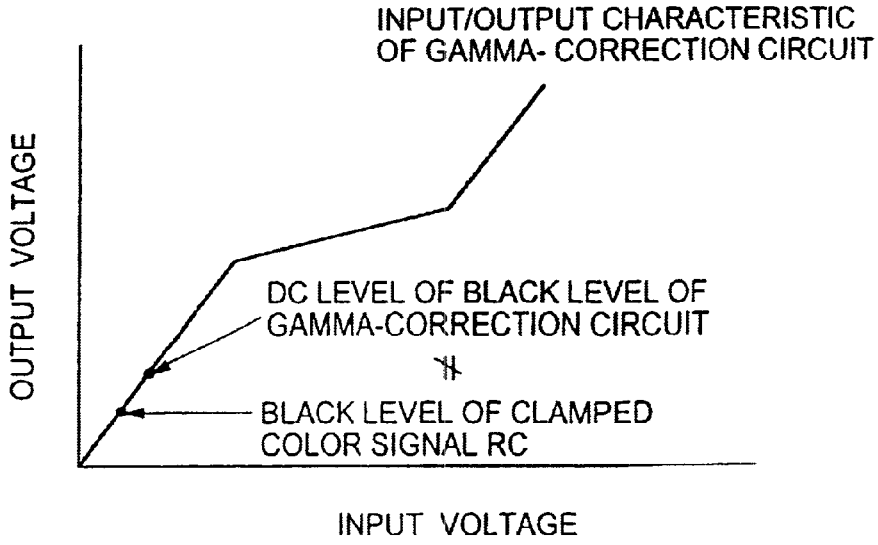
FIG.3 (PRIOR ART)
FIG. 3 is an input/output characteristic diagram showing an example of operation of a gamma-correction circuit according to a conventional example.

The black levels of the gamma-correction circuits 7, 8 and 9 are ideally set aiming at a specific voltage, but result in being actually varied among R, G and B or even among the gamma-correction circuits of the same color due to variation in accuracy of the gamma-correction circuits. As described in the prior art, therefore, when the black levels of clamped color signals RC, GC and BC are fixed, the black levels of the clamped color signals RC, GC and BC may be different from the black levels of the gamma-correction circuits (see FIG. 3). In such a state, therefore, a gamma correction cannot be correctly performed.

As described above, however, in order to amend this disadvantage, this embodiment provides the clamping voltage generating circuits 42, 52 and 62 respectively for the color signals R, G and B independently of one another and makes it possible to individually adjust the clamping voltages CR, CG and CB by means of control signals QR, QG and QB (hereinafter referred to as Q) from the CPU 10 so that the black levels set by the clamp units 4, 5 and 6 can coincide with the black levels of the gamma-correction circuits 7, 8 and 9.

More specifically, the RAM 11 is made to store the adjusted and changed digital data value of a control signal Q by combining the CPU 10 and the RAM 11. That is to say, at the beginning of using a display device, the clamping voltages CR, CG and CB are adjusted by changing the data of a control signal Q so as to meet said condition as initialization. After completion of the adjustment, each data of the control signal is stored in the RAM 11 as the initialization data. After this, even when power is repeatedly turned on/off, the CPU 10 uses the initialization data stored in the RAM 11 as the data of the control signal Q.

Accordingly, it is possible to solve the problems on display of variation in black level of gamma-correction circuits and slippage in color caused by setting of clamping voltages or fixation of the clamping voltages performed commonly to color signals R, G and B.

Hereinafter, operation of this embodiment in case that each of the color signals R, G and B of an input picture signal VI contains a setup level is described.

Figure 10:
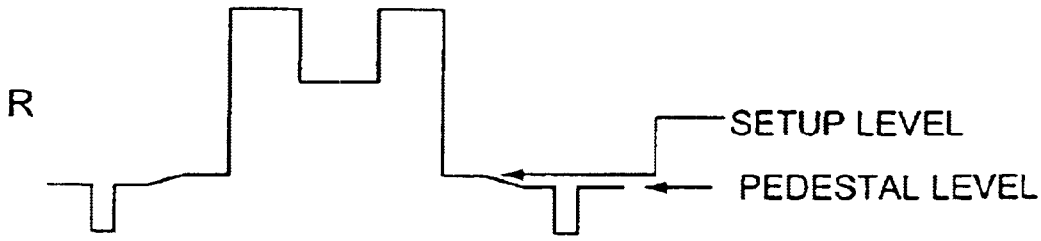
FIG. 10 is a timing chart showing an example of waveform of a color signal containing a setup level.

With reference to FIG. 10 showing in a timing chart an example of waveform in case that a color signal R of an input picture signal VI contains a setup level, a picture signal (a color signal R in this example) having a setup level refers to a picture signal whose black level is set at a level slightly higher than the pedestal level.

Here also, operation of a color signal R system is described as an example. When a color signal R having such a setup level is inputted into a conventional clamping circuit as described earlier, the clamping portion 41 results in operating so as to clamp the pedestal level, and therefore a level lower than the black level of a gamma-correction circuit 7 results in being recognized as a black level, as described in FIG. 3. As the result, since the black level of a gamma-correction circuit 7 and the black level of a clamped color signal CR become different from each other, a gamma correction is not correctly performed.

Furthermore, since the output of the gamma-correction circuit 7, namely, the black level voltage of the output color signal RG becomes a black level slightly slipped toward the white level (whitish), the ratio of a white level to a black level (contrast ratio) results in a deteriorated state.

In this embodiment, however, since the value of a clamping voltage CR to be supplied to the clamping portion 41 can be changed by the clamping voltage generating circuit 42, even if a color signal R containing a setup level is inputted it is possible to perform adjustment so as to make the black level of a clamped color signal RC and the black level of the gamma-correction circuit 7 coincide with each other.

More specifically, the data value of a control signal QR to be given to the D/A conversion circuit 421 from the CPU 10 is set lower by a setup level than the pedestal level of a color signal R, and a clamping voltage CR outputted from the clamping voltage generating circuit 42 is set lower by the setup level. Since this results in clamping the pedestal level of a color signal R to a level lower by a setup level than the pedestal level of an ordinary color signal R having no setup level (FIG. 9), it is possible to make the same as each other the black level of a clamped color signal RC when a color signal R containing this setup level is inputted and the black level of the gamma-correction circuit 7 at a later stage. The color signal G and B systems are processed in the same way.

Accordingly, it is possible to prevent incorrect operation in a gamma-correction circuit and deterioration in contrast ratio.

As described above, according to the present invention, each clamp unit includes a clamping voltage generating circuit and a clamping portion. The clamping voltage generating circuit generates such a clamping voltage that the black level of the above mentioned clamped color signal coincides with the black level in an input/output characteristic of a gamma-correction circuit in response to the first control signal. The clamping voltage is individually adjusted and supplied to the clamping portion. This clamping voltage is applied to the pedestal level of a color signal at a predetermined timing in response to the second control signal. This makes it possible to perform adjustment so as to make the black level of a color signal clamped by the clamping circuit coincide with the black level of the gamma-correction circuit at a later stage of the clamping circuit. Accordingly, even if the color signals of the gamma-correction circuits vary in black level, it is possible to make the black levels of the clamping voltages of these color signals R, G and B respectively coincide with the black levels of the respective gamma-correction circuits and thereby preventing incorrect operation of the gamma-correction circuits caused by fixedly setting the clamping voltages.

And since the operation of making the black level of a clamping circuit and the black level of a gamma-correction circuit coincide with each other is performed by individually adjusting each of the color signals R, G and B, it is possible to amend individually variation in black level of gamma-correction circuits and avoid a coloring phenomenon caused by difference among black level voltages.

Furthermore, since it is possible to perform a gamma correction correctly reproducing the black level, it is possible to prevent deterioration in contrast caused by variation in black level.

What is claimed is:

1. A clamping circuit for a liquid crystal display device comprising: a plurality of clamp units for receiving a plurality of input color signals of an input picture signal after deleting a DC bias from each of said input color signals to produce a plurality of clamped color signals, respectively, by adding a predetermined clamping voltage corresponding to a pedestal level of said input picture signal to each of said input color signals; and a plurality of gamma-correction circuits connected to said clamp units for receiving said clamped color signals, respectively, and for performing a predetermined gamma correction and amplification on each of said clamped color signals to produce output color signals, respectively; each of said clamp units being provided with a clamping portion for receiving said input color signal and a clamping voltage generating circuit for supplying a clamping voltage to said clamping portion so as to be controlled in response to an individual first control signal supplied thereto and generates said clamped color signal such that a black level of said clamped color signal coincides with a black level in an input/output characteristic of said gamma-correction circuit, and said clamping portion being supplied with said clamping voltage so as to add said clamping voltage to said pedestal level in a predetermined timing of said input color signal in response to a second control signal supplied thereto.

2. A clamping circuit for a liquid crystal display device according to claim 1, wherein;

said clamping voltage generating circuit is provided with a digital-to-analog (D/A) conversion circuit for performing a D/A conversion on a digital data signal contained in said first control signal and outputting an analog voltage signal, and a buffer circuit for buffer-amplifying said analog voltage signal and outputting said clamping voltage.

3. A clamping circuit for a liquid crystal display device according to claim 1, wherein;

said clamping portion is provided with a switch circuit for conducting or shutting said clamping voltage in response to the level of said second control signal.

4. A clamping circuit for a liquid crystal display device according to claim 1, further comprising a control unit for outputting said first and second control signals, and a memory unit for memorizing data from said control unit and reading and supplying said memorized data to said control unit.

5. A clamping circuit for a liquid crystal display device according to claim 1, wherein;

said first control signal is a serial control signal of a 3-line control method and has a digital data signal corresponding to said clamping voltage so as to be supplied to three control lines thereof, a clock signal for synchronization of said digital data signal and a strobe signal for specifying said clamping voltage generating circuit to be controlled.

6. A clamping circuit for a liquid crystal display device according to claim 1, wherein;

said second control signal is a signal which becomes a high level (H) for only a specific period of said pedestal level of said input color signal of one horizontal scanning period being one period of a horizontal synchronizing signal, and is generated by shifting the phase of said horizontal synchronizing signal by a predetermined time and inverting this shifted horizontal synchronizing signal.

7. A clamping circuit for a liquid crystal display device according to claim 1, wherein;

a black level of said input picture signal corresponds to said pedestal level.

8. A clamping circuit for a liquid crystal display device according to claim 1, wherein;

a black level of said input picture signal corresponds to a setup level which is higher by a fixed voltage than said pedestal level.

9. A clamping circuit for a liquid crystal display device according to claim 8, wherein;

said clamping voltage generating circuit sets said clamping voltage at said black level by setting a value of said digital data signal contained in said first control signal and corresponding to said clamping voltage, lower by said setup level than said pedestal level.

* * * * *